US006505560B1

(12) United States Patent
Kamdar et al.

(10) Patent No.: US 6,505,560 B1
(45) Date of Patent: Jan. 14, 2003

(54) SPRING DISC FOR SECURING A COMBUSTIBLE CARTRIDGE CASE TO A CASE BASE

(75) Inventors: Dipak S. Kamdar, Maple Grove, MN (US); Peter L. Langsjoen, St. Louis Park, MN (US); Todd A. VanSlyke, Rogers, MN (US); Frank Altamura, Budd Lake, NJ (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 09/923,852

(22) Filed: Aug. 7, 2001

(51) Int. Cl.[7] ..... F42B 5/18
(52) U.S. Cl. ..... 102/431; 102/467; 102/469
(58) Field of Search ..... 102/430–433, 102/464, 466, 467, 469, 470, 700

(56) References Cited

U.S. PATENT DOCUMENTS 157,916 A * 12/1874 Hotchkiss ..... 102/469
503,096 A * 8/1893 Mohr ..... 102/469
2,818,021 A * 12/1957 Boehm et al. ..... 102/469
4,928,598 A * 5/1990 Sabranski et al. ..... 102/469

FOREIGN PATENT DOCUMENTS

AT 259416 * 1/1968 ..... 102/469

* cited by examiner

*Primary Examiner*—Harold J. Tudor
(74) *Attorney, Agent, or Firm*—George A. Leone

(57) ABSTRACT

A spring disc includes a contiguous outer ring including a first plurality of holes and having a contiguous, upwardly curved portion having an outer edge. A middle ring encompasses a second plurality of holes, and a contiguous inner ring, is encompassed by the outer ring and the middle ring. The inner ring surrounds a central aperture sized to accommodate installation onto a cartridge case member, where the outer ring, inner ring and middle ring operate together so as to support the cartridge case by evenly distributing stresses when installed on a cartridge case. A taper angel θ is built into a bottom with a value of about 1° as measured from the bottom extending radially from the center of the inner ring to the outer edge with reference to a plane parallel to an imaginary plane overlaid on the contiguous outer edge.

17 Claims, 7 Drawing Sheets

SPRING DISC FOR SECURING A COMBUSTIBLE CARTRIDGE CASE TO A CASE BASE

U.S. GOVERNMENT RIGHTS

The U.S. Government has interests in this invention pursuant to Contract No. DAAE30-98-C-1094 awarded by the Department of the Army.

FIELD OF THE INVENTION

The present invention relates to combustible cartridge case construction, more particularly, it relates to a spring disc securing device for tank ammunition.

BACKGROUND OF THE INVENTION

Tank ammunition cartridges typically comprise a projectile including an obturator, and a combustible cartridge case assembled to a case base. The inability to chamber 120 mm tank ammunition multiple times without failure has been an ongoing problem for the U.S. Army and for allies who share the 120 mm gun system. One reason tank ammunition cartridges fail is due to the obturator sticking in the gun tube when the cartridge is chambered. Such jamming subsequently may result in destruction of the cartridge when it may be pulled apart upon extraction from the gun tube. Another problem in such cases is that a cartridge failure may also render the tank inoperable. The failure mode is due to flexibility of the case to case base joint that allows the projectile to move farther forward than the gun tube geometry permits. The result of the forward motion is that the obturator sometimes jams within the gun tube.

In the prior art, a spring disc is used to secure the combustible cartridge case to the cartridge base. One such spring disc 10 is shown in FIG. 1. Unfortunately, the prior art design does not offer broad contiguous support of the case nor does it distribute the load evenly, thereby producing an undue amount of localized stress. The prior art spring disc 10 includes a number of separated outer ring leaves 30.

As illustrated in FIG. 2, when installed into a cartridge assembly, a spring disc 10 of the prior art contacts the case only in a limited area 12 around the inner rim 14 of the spring disc, and a portion of the spokes 22. When installed, the outer rim 16 moves away from the cartridge case as indicated by double arrow 21. In the example of a 120 mm cartridge, the outer rim moves above the cartridge surface 20. The result is that loads are concentrated about the inner rim 14, resulting in pinching the case, thereby increasing the likelihood of failure. In a typical cartridge, the localized high stresses are very close to the tensile strength of the cartridge case, thereby increasing the likelihood of failure of the cartridge upon extraction.

In order to improve upon currently available devices, an improved spring disc that uses the same base material and the same plating as the prior art spring disc is needed. Further, since the same or similar gun systems are used throughout the world, it is desirable to minimize the number of new parts.

In an attempt to meet these challenges, a different solution included the use of a glued, snap-in, case-to-case-base joint. The glued snap-in design proved to be unsatisfactory. It provided about three times the tensile load carrying capability of the prior art design, but it was rigid and could not absorb the shock of chambering and extraction, resulting in failure of the case. A variation of the snap-in design used a mechanical interlock for attaching the case to a rubber seal on the case base. It was believed that the rubber seal would provide some degree of shock absorption. It is believed that the mechanical interlock solution is unsatisfactory and is no longer being pursued.

SUMMARY OF THE INVENTION

The present invention provides a spring disc for securing a combustible cartridge case to a case base, the spring disc includes a contiguous outer ring including a first plurality of holes and having a contiguous, upwardly curved portion having as outer edge. A contiguous middle ring encompasses a second plurality of holes and a contiguous inner ring, is encompassed by the outer ring and the contiguous middle ring. The inner ring surrounds a central aperture sized to accommodate installation onto a cartridge case member, where the outer ring, inner ring and middle ring operate together so as to support the cartridge case by evenly distributing stresses. A bottom includes the contiguous outer ring, contiguous inner ring and contiguous middle ring. A taper angel $\theta$ is built into the bottom and the taper angle $\theta$ has a value of at least 1° as measured from the bottom extending radially from the center of the contiguous inner ring to the outer edge with reference to a plane parallel to an imaginary plane overlaid on the contiguous outer edge.

In one aspect, the invention provides a spring disc that makes the joint between a cartridge case and case base stiffer to reduce forward travel, yet reduce stresses in the case, without requiring changes to components that are common to 120 mm rounds.

In another aspect of the invention, a spring disc for securing a combustible cartridge case to a case base allows 120 mm cartridges to be chambered and extracted multiple times in a gun tube without separation of the case from the case base.

The spring disc provided by the present invention features a contiguous ring to support a case evenly and reduce localized stresses.

The spring disc provided by the present invention features sufficient stiffness for absorbing chambering shocks, while, at the same time, reducing forward travel of the projectile to prevent the cartridge from jamming in the gun tube.

The spring disc provided by the present invention also features sufficient cutouts and free space under the spring to insure complete burnout of the case so that it is residue free after firing.

The spring disc provided by the present invention features improved stiffness to prevent projectile sticking while providing adequate shock absorption.

The spring disc provided by the present invention also features proven superiority over the prior art design, as shown in testing, by surviving multiple chamber and extract cycles without failure.

Another feature of the invention is that it provides a spring disc that may be used on a variety of tank ammunition cartridges, yet requires no modifications to the prior art case base and seal, combustible cartridge case, or retaining ring.

DETAILED DESCRIPTION OF THE PREFERRED EMBODIMENTS

While the invention will be described herein with respect to certain specific useful embodiments, it will be understood that these examples are by way of illustration and that the invention is not limited by these examples. For example, while particular reference is made to 120 mm cartridges, it will be apparent that the spring disc of the invention has applicability to a wide range of cartridge sizes and types.

Figure 1:
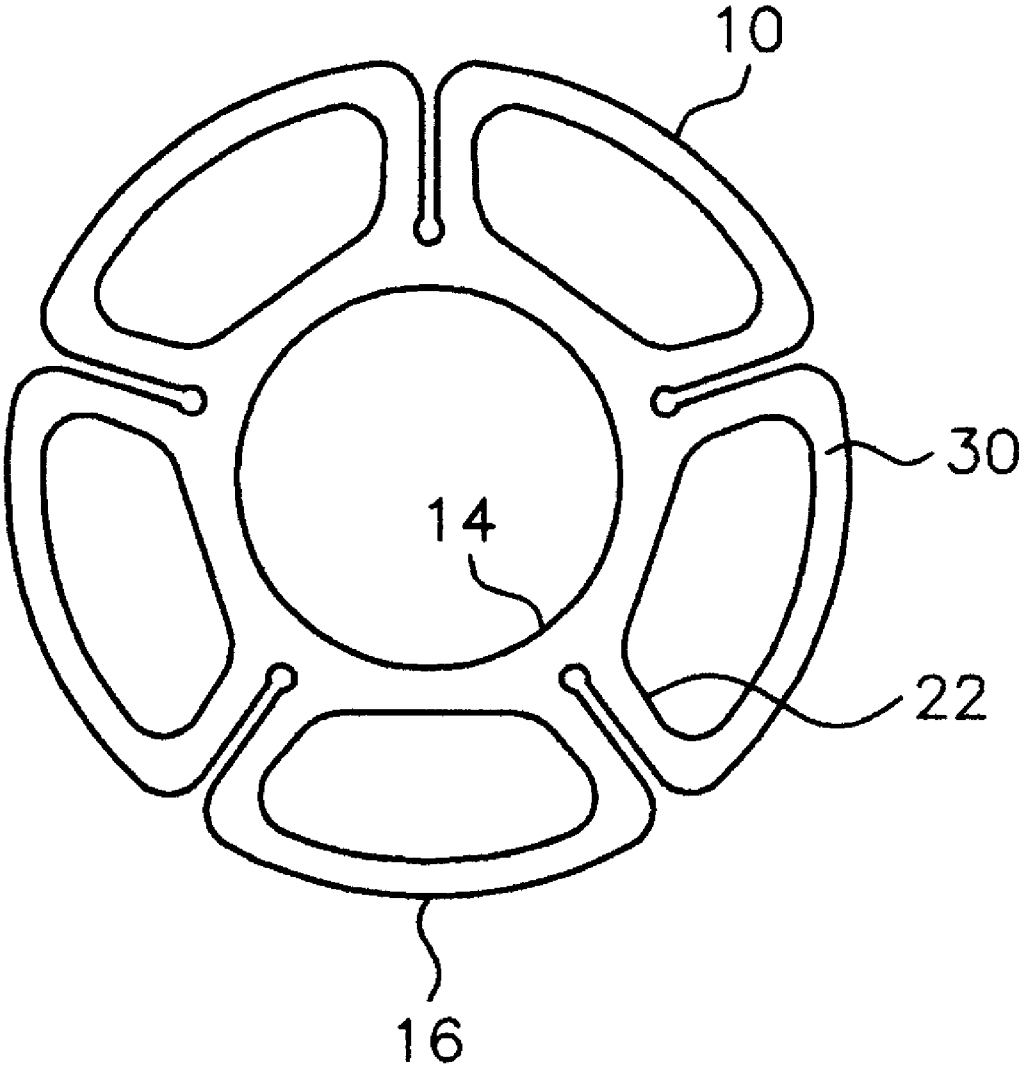
Fig-1 (Prior Art)
FIG. 1 illustrates a top view schematic of a prior art spring disc for securing a combustible cartridge case to a case base.
Figure 2:
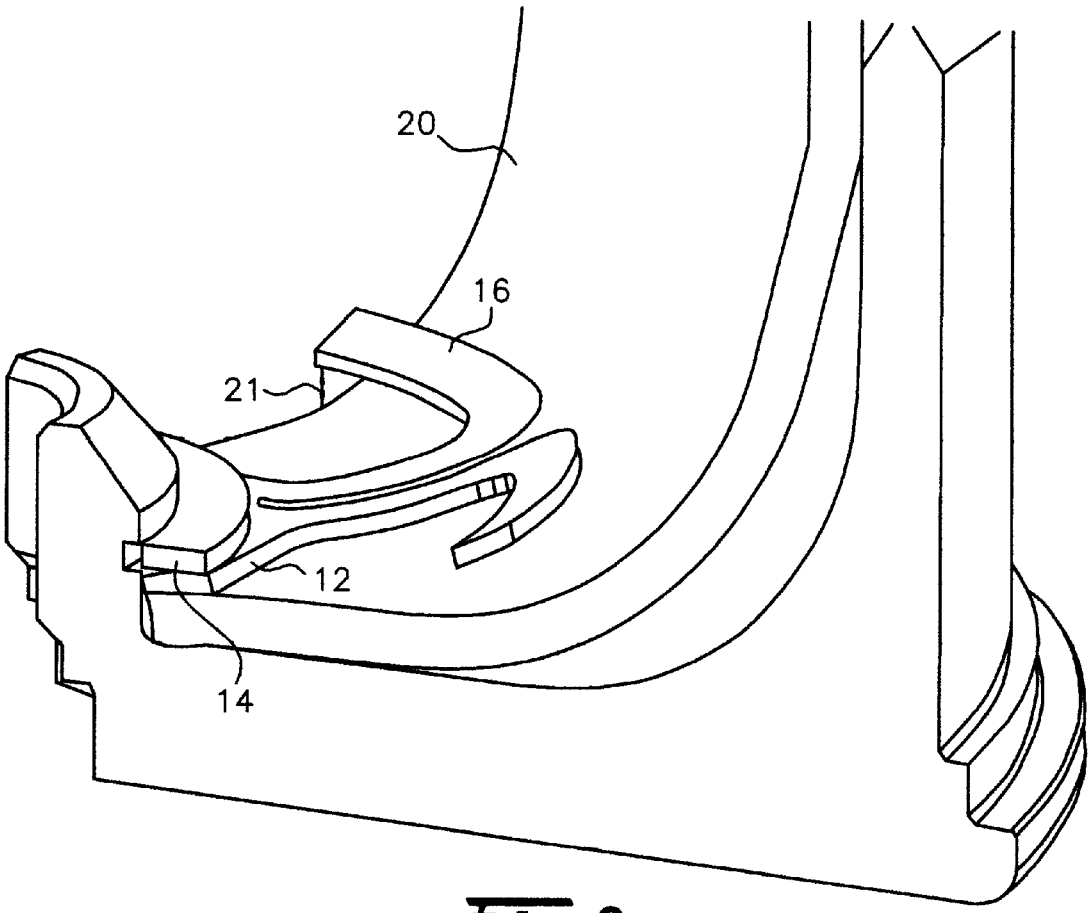
Fig-2 (Prior Art)
FIG. 2 illustrates a partial cut-away perspective view schematic of a prior art spring disc securing a combustible cartridge case to a case base.
Figure 3:
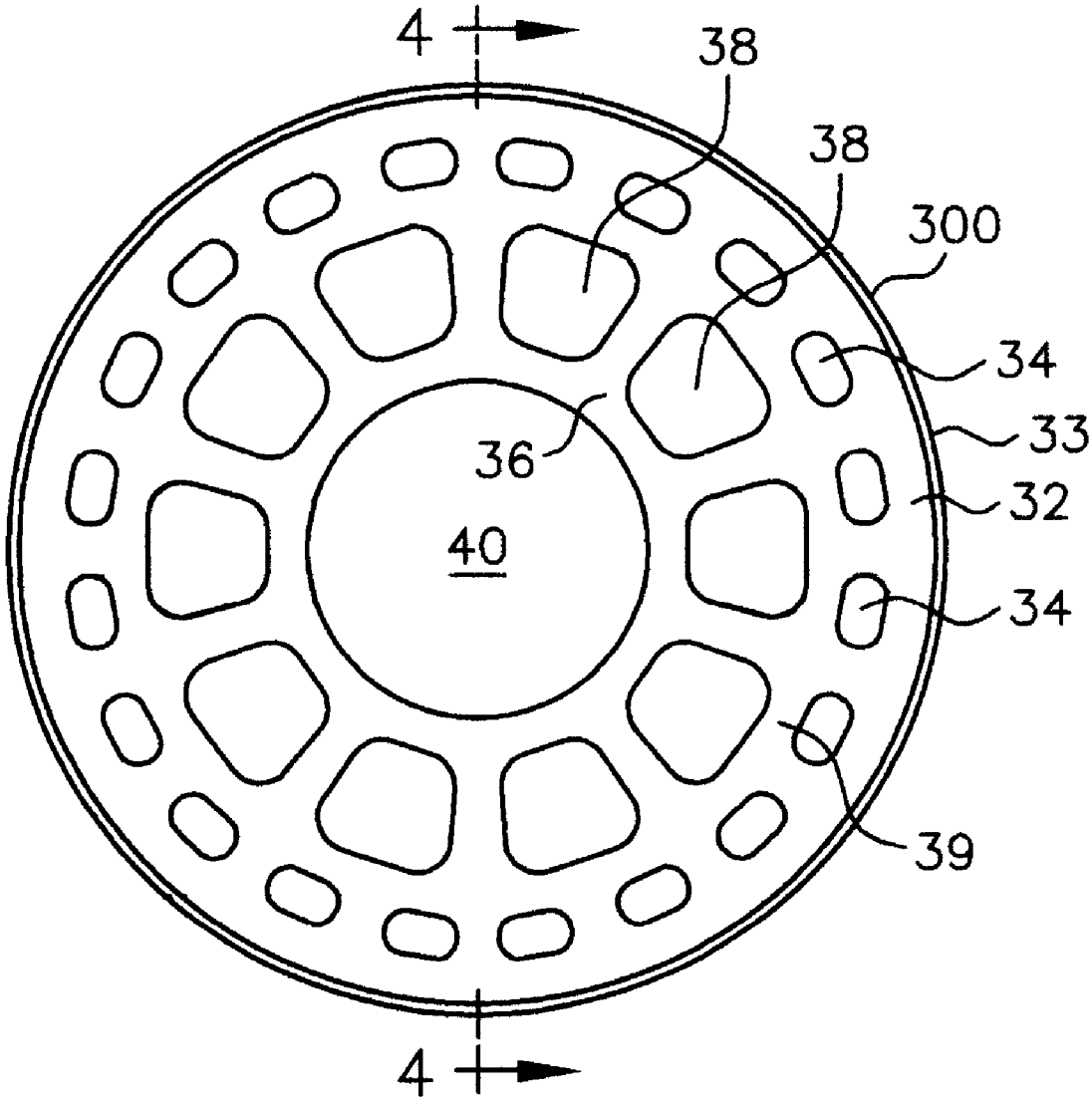
FIG. 3 illustrates a top view schematic of an exemplary spring disc for securing a combustible cartridge case to a case base as used in one embodiment of the invention.

Referring now to FIG. 3, FIG. 3 illustrates a top view schematic of an exemplary spring disc 300 for securing a combustible cartridge case to a case base as used in one embodiment of the invention. The spring disc 300 comprises a contiguous outer ring 32 having a first plurality of holes 34, and a middle 39 ring having a second plurality of holes 38. The contiguous outer ring 32 includes a contiguous, upwardly curved portion having as outer edge 33. A contiguous inner ring 36, is encompassed by the outer ring and the middle ring. The outer ring, inner ring and middle ring surround a central aperture 40, where the outer ring, inner ring and middle ring operate together so as to support the cartridge case by evenly distributing stresses around the cartridge joint.

In a preferred embodiment, each of the first plurality of holes 34 is generally oblong and each is smaller than one of the second plurality of holes. In a preferred embodiment, each of the second plurality of holes 38 is generally trapezoidal and each is larger than one of the first plurality of holes. The central aperture 40 is sized to accommodate installation onto a cartridge case member. Thus, when installed the spring disc 300 supports the combustible cartridge case by distributing the load evenly, and reducing the local stress concentrations found in the prior art design. By comparison, a typical prior art design supports the case at only five points creating regions of high localized stress.

In a preferred embodiment for 120 mm cartridges, the outer diameter of the ring is about 124 mm. This diameter distributes the load over a larger area than prior designs, further reducing localized stresses. One of the important design features of the new spring is its stiffness. The new spring is approximately four times stiffer than the prior art design. This reduces the forward travel of the projectile when chambered, and prevents it from sticking in the forcing cone. At the same time it retains enough flexibility to absorb the shock of chambering and extraction without damaging the case. It balances the stiffness of the joint, forward travel of the projectile and stresses in the case.

In one embodiment, the spring disc is made from Grade 10740 cold rolled high carbon strip steel with a thickness of 1.27+/−0.07 mm. This is the same material and thickness used in making the prior art spring disc. The spring disc may comprises a metal selected from the group consisting of steel, high carbon steel, low carbon steel, aluminum, nickel, stainless steel, beryllium, lithium, chromium and steel alloys.

In one example of the invention, the spring disc may have an outer diameter larger than 100 mm where the first plurality of holes 34 comprises at least 20 holes located around a generally uniform radius and the second plurality of holes 38 comprises at least 10 holes located around a generally uniform radius.

In one example, a spring disc made in accordance with the invention comprises a circular disc with a central hole of interior diameter of about 45.2 mm, an outer diameter of about 124.25 mm, and thirty cutouts. The first plurality of holes 34 numbered twenty uniformly distributed holes located around a generally uniform radius, and separated from each other around the outer ring by about 5 mm. The second plurality of holes 38 numbered ten uniformly distributed holes located around a generally uniform radius, and separated from each other around the inner ring by about 5 mm. Thus, the spring disc is formed to create a profile that balances the stiffness, stresses, and assembly load needs of the cartridge.

Figure 4:
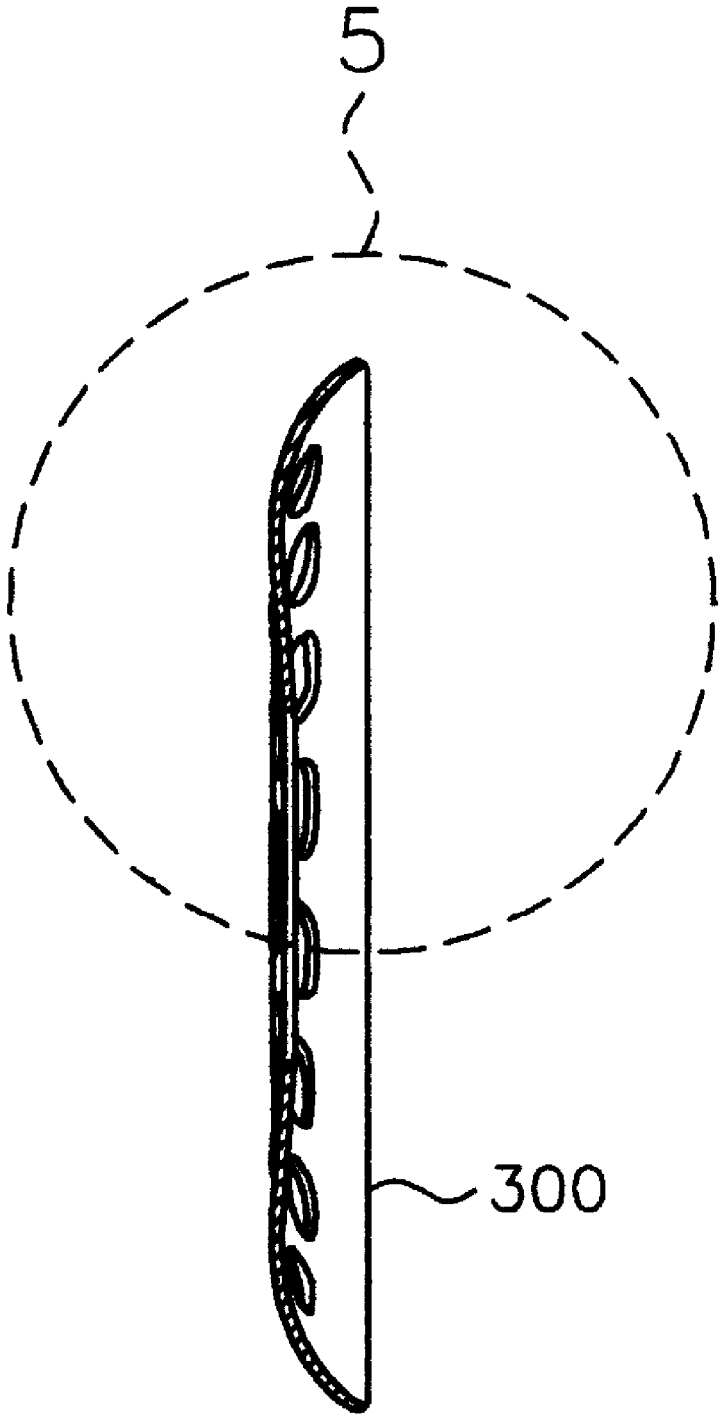
FIG. 4 shows a cross-sectional view of an example of a spring disc for securing a combustible cartridge case to a case base configuration as contemplated by one embodiment of the invention.
Figure 5:
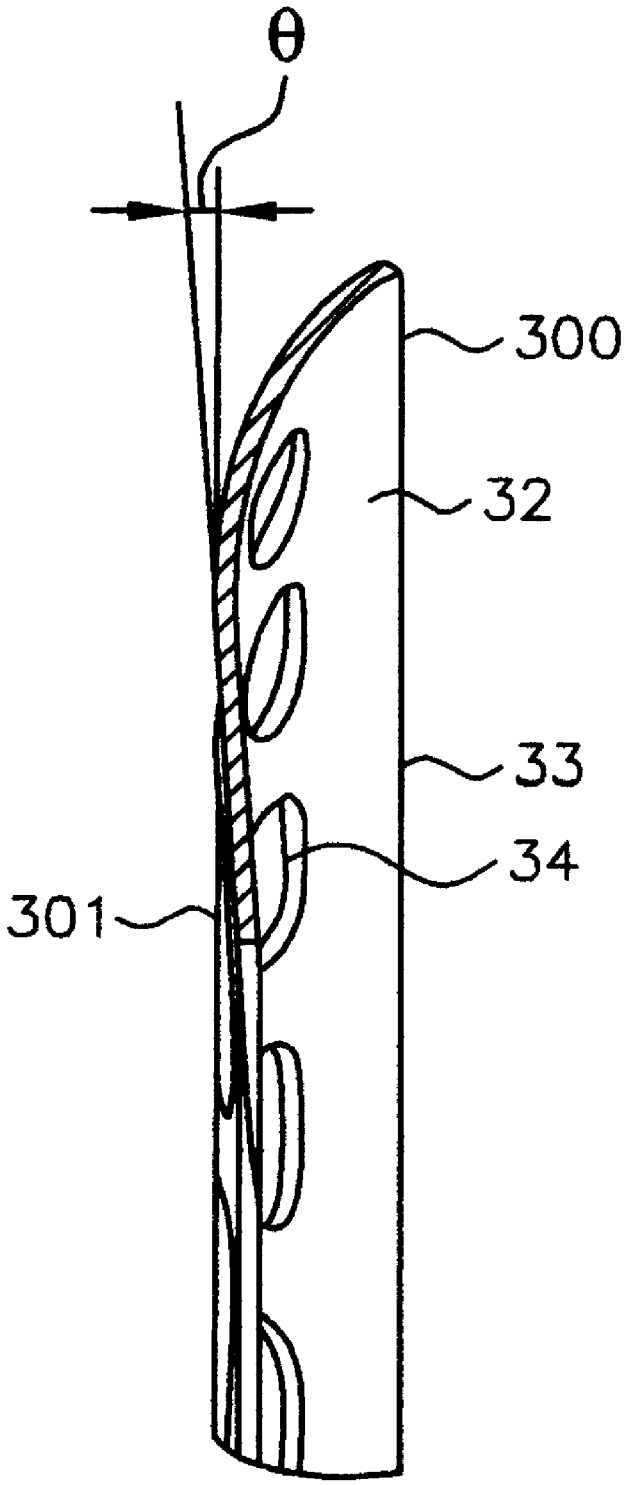
FIG. 5 shows a more detailed side view of a spring disc for securing a combustible cartridge case to a case base configuration as contemplated by one embodiment of the invention.

Referring now to FIG. 4, FIG. 4 shows a cross-sectional view of an example of the spring disc 300 for securing a combustible cartridge case to a case base configuration as contemplated by one embodiment of the invention. Referring now to FIG. 5, FIG. 5 shows a more detailed side view of a spring disc for securing a combustible cartridge case to a case base configuration as contemplated by one embodiment of the invention. A taper angle θ, is built into the bottom 301 of the spring disc 300 in order to assure that the spring disc properly distributes a load on the cartridge case when installed. The taper angel θ extends radially from the center of the spring disc to the outer edge and is measured as referenced to a plane parallel to an imaginary plane overlaid on an outer edge 33 of the contiguous outer ring 32. In one embodiment for 120 mm cartridges the taper angel θ was about 4°, but may advantageously be an angle of at least 1°. Other taper angles may be suitable depending upon the cartridge application.

Figure 6:
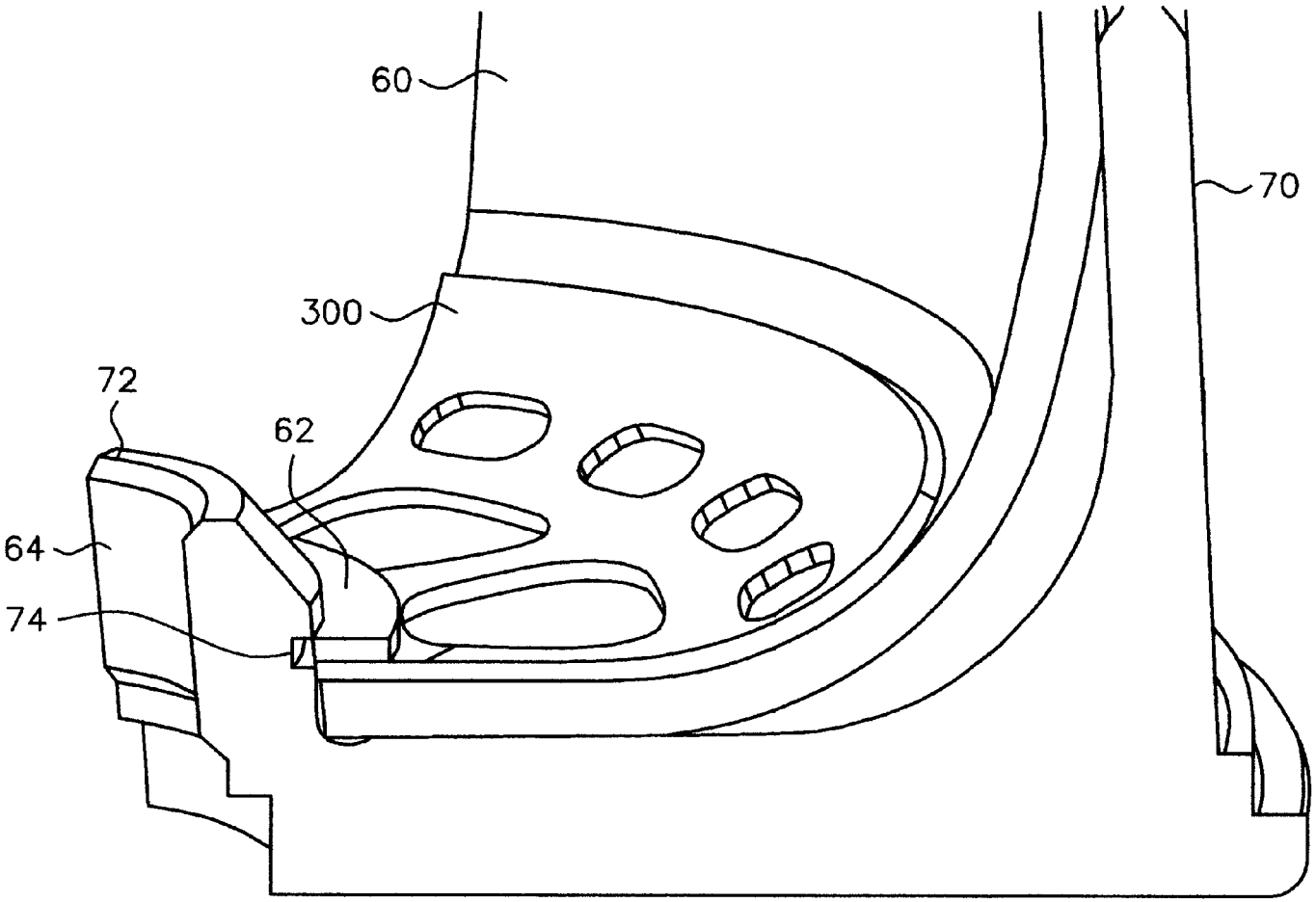
FIG. 6 illustrates a partial cut-away perspective view schematic of a spring disc securing a combustible cartridge case to a case base as contemplated by one embodiment of the invention.

FIG. 6 illustrates a partial cut-away perspective view schematic of a spring disc 300 securing a combustible cartridge case 60 to a case base 70 as contemplated by one embodiment of the invention. During installation, the spring disc 300 is forced over a protruding conical base member 64. The conical base member 64 has a generally conical receiving end 72 and a groove 74 adapted to accept a retaining ring 62. When fully installed the retaining ring 62 bears against the spring disc 300 that, in turn, bears against the combustible cartridge case 60. Typically, the cartridge case comprises a combustible material such as a nitro-cellulose material.

Testing proved the new spring disc design to be significantly superior to the existing design. In one test, spring discs in multiple cartridges were successful in 50 of 50 chamber and extract attempts. In another test spring discs were successful in 69 of 70 attempts. Some of the chambering attempts were considered extremely harsh as compared to loading procedures under normal conditions. In the same tests most of the prior art cartridges failed on the first attempt.

Figure 7:
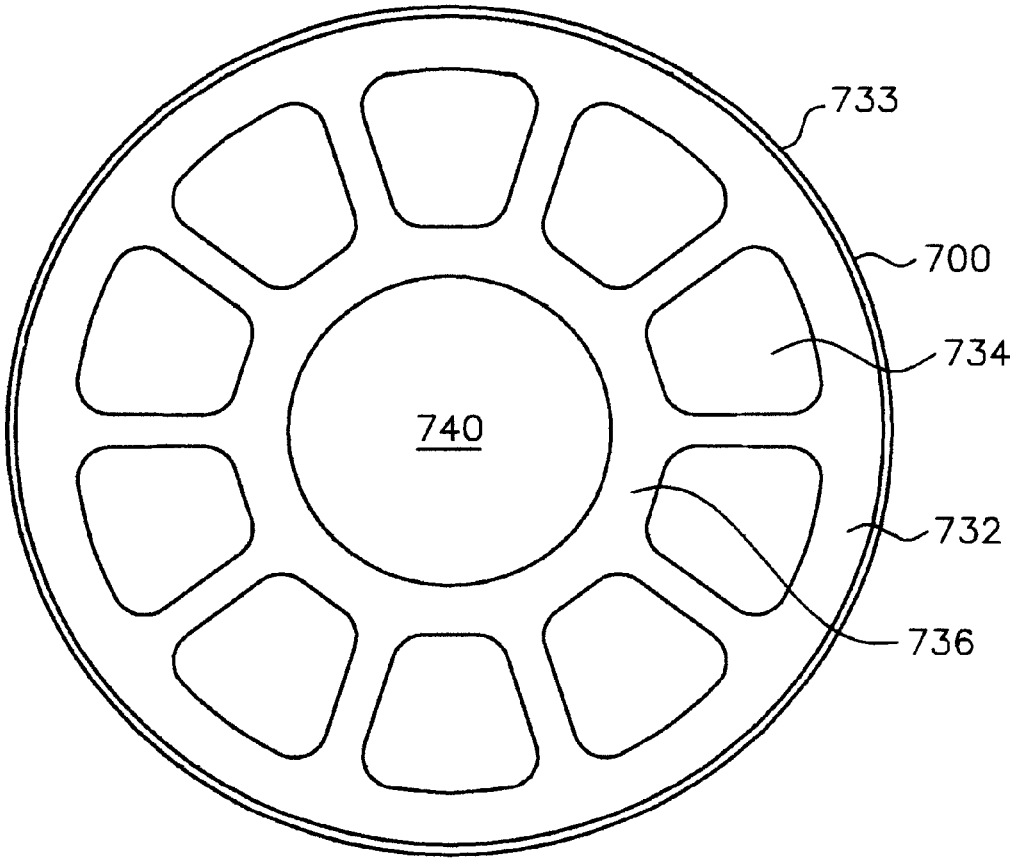
FIG. 7 illustrates a top view schematic of an alternative embodiment of a spring disc for securing a combustible cartridge case to a case base as used in one embodiment of the invention.
Figure 8:
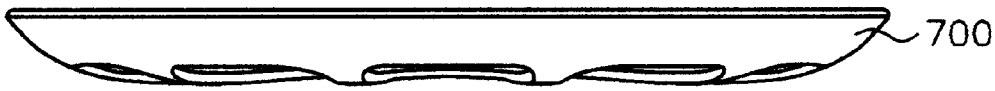
FIG. 8 shows a side view of an example of the alternative spring disc of FIG. 7.

Referring now to FIG. 7, FIG. 3 illustrates a top view schematic of an alternative embodiment of a spring disc 700 for securing a combustible cartridge case to a case base as used in one embodiment of the invention. The spring disc 700 comprises a contiguous outer ring 732 having a plurality of holes 734, and an inner ring 736 having a central aperture 740. The contiguous outer ring 732 includes a contiguous, outer edge 733. FIG. 8 shows a side view of the spring disc 700. The spring disc 700 is constructed with a taper angle as described above of is at least 1°.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment and devices, and that various modifications, both as to the equipment details and operating procedures, may be accomplished without departing from the true spirit and scope of the present invention.

What is claimed is:

1. A spring disc for securing a combustible cartridge case to a case base comprising:

(a) a contiguous outer ring including a first plurality of holes and having a contiguous, upwardly curved portion having an outer edge;

(b) a contiguous middle ring encompassing a second plurality of holes;

(c) a contiguous inner ring, encompassed by said contiguous outer ring and said contiguous middle ring, the contiguous inner ring surrounding a central aperture sized to accommodate installation onto a cartridge case base member, where the contiguous outer ring, contiguous inner ring and contiguous middle ring operate together so as to support the cartridge case by evenly distributing stresses; and (d) a bottom including the contiguous outer ring, contiguous inner ring and contiguous middle ring, wherein a taper angel θ is built into the bottom and the taper angle θ has a value of at least 1° as measured from the bottom extending radially from the center of the contiguous inner ring to the outer edge with reference to a plane parallel to an imaginary plane overlaid on the contiguous outer edge.

2. The spring disc of claim 1 wherein each of the first plurality of holes is generally oblong and each is smaller than one of the second plurality of holes.

3. The spring disc of claim 1 wherein each of the second plurality of holes is generally trapezoidal and each is larger than one of the first plurality of holes.

4. The spring disc of claim 1 wherein the spring disc has an outer diameter larger than 100 mm.

5. The spring disc of claim 1 wherein the spring disc comprises a metal selected from the group consisting of steel, high carbon steel, low carbon steel, aluminum, nickel, stainless steel, beryllium, lithium, chromium and steel alloys.

6. The spring disc of claim 1 wherein the first plurality of holes comprises at least twenty holes located around a generally uniform radius.

7. The spring disc of claim 1 wherein the second plurality of holes comprises at least ten holes located around a generally uniform radius.

8. The spring disc of claim 1 wherein the taper angel θ is between 4° and 1°.

9. In a cartridge having a combustible cartridge case and case base secured by a spring disc for securing the cartridge case to the case base, an improved spring disc comprising:

(a) a contiguous outer ring encompassing a first plurality of holes and having a contiguous, upwardly curved portion having an outer edge;

(b) a contiguous middle ring encompassing a second plurality of holes;

(c) a contiguous inner ring, encompassed by said contiguous outer ring and said contiguous middle ring, the contiguous inner ring surrounding a central aperture sized to accommodate installation onto a cartridge case base member, where the contiguous outer ring, contiguous inner ring and contiguous middle ring operate together so as to support the cartridge case by evenly distributing stresses; and d) a bottom including the contiguous outer ring, contiguous inner ring and contiguous middle ring, wherein a taper angel θ is built into the bottom and the taper angle θ has a value of between 4° and 1° as measured from the bottom extending radially from the center of the contiguous inner ring to the outer edge with reference to a plane parallel to an imaginary plane overlaid on the contiguous outer edge.

10. The cartridge of claim 9 wherein each of the first plurality of holes is generally oblong and each is smaller than one of the second plurality of holes.

11. The cartridge of claim 9 wherein each of the second plurality of holes is generally trapezoidal and each is larder than one of the first plurality of holes.

12. The cartridge of claim 9 wherein the spring disc has an outer diameter larger than 100 mm.

13. The cartridge of claim 9 wherein the spring disc comprises steel, high carbon steel, low carbon steel, aluminum, nickel, stainless steel, beryllium, lithium, chromium and steel alloys.

14. The cartridge of claim 9 wherein the first plurality of holes comprises at least twenty holes.

15. The cartridge of claim 9 wherein the second plurality of holes comprises at least ten holes located around a generally uniform radius.

16. A spring disc for securing a combustible cartridge case to a case base comprising:

(a) a contiguous outer ring encompassing a plurality of holes and having a contiguous, upwardly curved portion having an outer edge;

(b) a contiguous inner ring encompassing a central aperture, the central aperture sized to accommodate installation onto a cartridge case base member, the contiguous outer ring, contiguous inner ring and central aperture operating together; and (c) a bottom including the contiguous outer ring and said plurality of holes, and contiguous inner ring, wherein a taper angel θ is built into the bottom and the taper angle θ has a value of at least 1° as measured from the bottom extending radially from the center of the contiguous inner ring to the outer edge with reference to a plane parallel to an imaginary plane overlaid on the contiguous outer edge.

17. The spring disc of claim 16 wherein the spring disc comprises a metal selected from the group consisting of steel, high carbon steel, low carbon steel, aluminum, nickel, stainless steel, beryllium, lithium, chromium and steel alloys.

* * * * *